US005083558A

United States Patent [19]

Thomas et al.

[11] Patent Number: 5,083,558

[45] Date of Patent: Jan. 28, 1992

[54] MOBILE SURGICAL COMPARTMENT WITH MICRO FILTERED LAMINAR AIR FLOW

[76] Inventors: William R. Thomas, 187 Main St., Conyngham, Pa. 18219; Robert F. Hoyt, Jr., 14501 Chrisman Hill Dr., Boyds, Md. 20841

[21] Appl. No.: 609,880

[22] Filed: Nov. 6, 1990

[51] Int. Cl.[5] ..... A61G 10/02

[52] U.S. Cl. ..... 128/202.12; 128/202.13; 128/202.16; 128/897; 55/385.2; 55/DIG. 18; 454/57; 454/63; 454/DIG. 93

[58] Field of Search ..... 128/202.12, 202.13, 128/202.16, 200.24, 204.18, 897, 898; 98/115.1, 115.2, 115.3, 115.4; 55/385.2, DIG. 29, DIG. 18, DIG. 35, 279

[56] References Cited

U.S. PATENT DOCUMENTS

| | | | |
|---|---|---|---|
| 2,243,999 | 3/1938 | Chapple | 55/385.2 X |
| 2,633,842 | 4/1953 | Higgs | 55/385.2 X |
| 2,700,384 | 1/1955 | Ivory | 128/202.16 |
| 3,041,957 | 7/1962 | Liptay | 98/115 |
| 3,148,956 | 9/1964 | Hetherwick | 55/DIG. 29 X |
| 3,301,167 | 1/1967 | Howard et al. | 98/115 |
| 3,363,539 | 1/1968 | Taylor et al. | 98/115 |
| 3,462,920 | 8/1969 | Denny | 55/413 |
| 3,487,766 | 1/1970 | Wood | 98/31 |
| 3,505,989 | 4/1970 | Trohan | 55/385.2 X |
| 3,511,162 | 5/1970 | Truhan | 98/36 |
| 3,626,837 | 12/1971 | Pelosi, Jr. et al. | 98/36 |
| 3,777,736 | 12/1973 | Van Der Waaij | 55/385.2 X |
| 3,820,536 | 6/1974 | Anspach, Jr. et al. | 128/202.13 |
| 3,897,721 | 8/1975 | Fuhst | 98/115 R |
| 3,926,597 | 12/1975 | Lanoy | 98/115.3 |
| 3,944,405 | 3/1976 | Van Calsteren et al. | 98/115.3 |
| 4,016,809 | 4/1977 | Austin | 98/115.4 X |
| 4,045,192 | 8/1977 | Eckstein et al. | 98/115.4 X |
| 4,060,025 | 11/1977 | Pelos, Jr. | 98/40 DL |
| 4,098,174 | 7/1978 | Landy | 98/115.3 |
| 4,100,847 | 7/1978 | Norton | 98/115.3 |
| 4,179,984 | 12/1979 | Gorcey | 98/115.3 |
| 4,202,676 | 5/1980 | Pelosi, Jr. et al. | 98/115.4 X |
| 4,343,261 | 8/1982 | Thomas | 119/15 |
| 4,402,280 | 9/1983 | Thomas | 119/15 |
| 4,526,133 | 7/1985 | LoMaglio | 119/17 |
| 4,557,184 | 12/1985 | Orll et al. | 98/115.3 |
| 4,637,301 | 1/1987 | Shields | 98/115.3 |
| 4,657,004 | 4/1987 | Coffey | 128/134 |
| 4,660,464 | 4/1987 | Tanaka | 98/115.3 |
| 4,690,100 | 9/1987 | Thomas | 119/15 |
| 4,723,480 | 2/1988 | Yagi et al. | 98/115.3 |
| 4,804,392 | 2/1989 | Spengler | 98/115.3 X |
| 4,832,717 | 5/1989 | Peters | 98/115.3 X |
| 4,852,468 | 8/1989 | Harris | 98/115.3 |
| 4,923,352 | 5/1990 | Tamura et al. | 98/115.3 X |
| 4,927,438 | 5/1990 | Mears et al. | 55/385.2 |
| 4,934,256 | 6/1990 | Moss et al. | 98/115.3 |
| 4,949,714 | 8/1990 | Orr | 128/200.24 |

FOREIGN PATENT DOCUMENTS

| | | | |
|---|---|---|---|
| 7805202 | 5/1977 | Netherlands | 128/202.12 |

OTHER PUBLICATIONS

Labcon Co., Lab Equipment Catalog 1966, pp. 42–45.

Advertisement for "Clean Air Units," International Portland Corp., Ned #251.

*Primary Examiner*—David A. Wiecking

*Assistant Examiner*—Eric P. Raciti

*Attorney, Agent, or Firm*—Eckert Seamans Cherin & Mellott

[57] ABSTRACT

Surgical procedures are conducted in a protected environment wherein a laminar flow of micro filtered air is passed from a top to a bottom of an enclosure with transparent panels defining a space for manual access of the surgeon's hands and arms. Air circulation is forced through a high performance HEPA filter between an inlet including the bottom of the enclosure and an outlet at the top, both including panels with an array of apertures for establishing substantially laminar flow. A duct along an endwall of the enclosure carries filtered air to the top. A positive pressure differential is maintained between the inside of the surgical compartment and the outside, to protect the patient operative site from contamination by airborne particles. The enclosure rests on top of a mobile cabinet and has access ports for connection lines and also for bringing the surgical subject into the enclosure. For experimental animals, an access port for cage boxes can be provided. A microscope is movably mounted in the enclosure, with the object lenses disposed outside the enclosure on an extension which can extend through the access port.

18 Claims, 3 Drawing Sheets

MOBILE SURGICAL COMPARTMENT WITH MICRO FILTERED LAMINAR AIR FLOW

BACKGROUND OF THE INVENTION

1. Field of the Invention

This invention relates to the field of protective enclosures for laboratory and clinical medicine use, and in particular to a mobile enclosure which produces a vertical laminar flow of micro filtered air in an enclosure that permits two-sided manual access under a transparent sidewall to an operating field, and facilitates surgical procedures on laboratory animals as well as on humans.

2. Prior Art

Laboratory work chambers or hoods are well known. In a typical hood the object is to confine fumes produced in chemical reactions to the enclosure defined by the hood, possibly exhausting the fumes by a powered ventilator. The hood typically is operated at a negative pressure differential relative to the outside such that none of the fumes escape. In certain applications the object is to keep particulate matter out of the work area, in which case the work chamber can be operated at positive pressure and provided with a filter for removing particles from air pumped into the enclosure. The outlet of filtered air into the enclosure is disposed in the rear of the work chamber or in the top.

U.S. Pat. No. 4,016,809—Austin discloses a clean air workbench including a HEPA filter for removing particles from air pumped through the rear wall of a work chamber using a fan. The air passes horizontally from the rear wall through an open front of the chamber. U.S. Pat. No. 3,301,167—Howard et al and U.S. Pat. No. 3,363,539—Taylor et al use air flow that is directed obliquely to the front of a protective enclosure.

U.S. Pat. No. 4,100,847—Norton discloses a laminar flow cabinet wherein a transparent vertically movable front closure panel covers all or part of the front and a laminar flow is obtained from a filter mounted in the top and the peripheral edges of a bottom panel, spaced from the sidewalls to define a duct leading to a fan. The air moves upwardly in a duct in the rear wall and downwardly in an air curtain to the gap between the bottom panel and the sidewalls.

Protected enclosures of the foregoing types are useful for certain applications which require the exclusion of airborne particles. However, the devices are arranged for substantially enclosing the protected area and do not permit a great deal of access for manual operations, or other features that are useful with respect to surgical procedures. Air flow installations for surgical procedures on the other hand have been characterized by attempts to avoid structures which confine the area to be protected. In U.S. Pat. No. 4,063,495—Duvlis, filtered air is emitted from an exhaust head directed at a patient's appendage and is collected at a suction head across from the appendage. The device does not exclude particulate matter entering the air stream from the ambient air. U.S. Pat. No. 4,045,192—Eckstein et al discloses a mobile device that simply emits clean air toward the patient. U.S. Pat. Nos. 3,462,920 and 3,511,162, to Denny and Truhan respectively, disclose clean air devices attempting to encompass a patient's bed. As with Duvlis, such devices do not exclude particulate matter entering the air stream from the ambient air.

In connection with surgical equipment, it is known to arrange an entire operating room to define a laminar flow of filtered air from the ceiling to the floor. A room configured in this manner is shown, for example in Turner, Journal of Bone and Joint Surgery, 56-A(2), page 431, 1974. Reference can also be made to U.S. Pat. Nos. 4,060,015 and 3,626,837, both to Pelosi, Jr. Such an installation must be built into the structural members of the operating room.

It is at times desirable to provide a sterile environment within an otherwise relatively pathogen laden area. For example, in the event of minor surgical procedures or for expediency in connection with battlefield surgery or mass casualty disasters and the like, it may not be possible or cost effective to arrange a full scale operating room environment. Nevertheless, the surgeon requires full access to the operative site of the patient, and furthermore, it is generally necessary to provide full access to such area for at least two persons. There is a need to provide the sterility advantages and the full access attributes of full size clean room apparatus, but also to provide a means by which this can be packaged in a small and mobile fixture for use in any environment.

Laboratory animal surgery is a particularly good application of a device as proposed. Small laboratory animals such as mice, rats, rabbits, etc., are often quartered in high density housing arrangements, some having individual cage box ventilation and individual watering hookups, the cage boxes being normally housed in a rack, as shown for example in U.S. Pat. Nos. 4,343,261 and 4,402,280—Thomas. The occupants of the cages may represent various experiments requiring surgical procedures at one time or another. When conducting surgical procedures on a number of subjects, a mobile operating chamber would allow the surgeon to bring the clean environment into convenient proximity with the animal housing system or a researcher's laboratory, and to perform necessary procedures on the occupants of individual cages. However, it should be noted that the environment of the animal housing system may have a high density of airborne particles due to dust and dander associated with the animals. A high performance device allowing substantially complete isolation of the surgical subject (or at least the operative site), essentially bathing the operative site in HEPA filtered laminar air flow, and also permitting complete access to the subject by at least two persons and mobility, would facilitate experimentation or surgical manipulation of the surgical subject in a practical and efficient manner.

The present invention provides a laminar flow isolation apparatus resembling a laboratory hood enclosure, but with full access and visibility from opposite sides of an operating field. A flow of HEPA filtered class 100 air passes vertically downwardly over the subject, this air being substantially less contaminated than the class 10,000 air which characterizes the typical full size operating room. The air is filtered through a block of filter material disposed in a mobile base cabinet and brought to a plenum over the operating field by means of a duct formed by a hollow endwall of the enclosure. The plenum in the top has an array of openings, which can be inclined to increase air flow adjacent the sidewalls to form an air curtain isolating the clean air flow from the outside. The air from the top moves downwardly to corresponding openings in the base of the operating field, namely the upper wall of the cabinet, through which a portion of the air is recycled through the filter. The surgeon(s) and assistants having full access from opposite sides of the mobile enclosure are nevertheless completely removed from the operating area, only the hands and forearms coming into the protected space. This helps to facilitate maximum patient protection by minimizing possible patient operative site contamination from the surgical team's faces, foreheads, necks, and other areas not routinely covered by traditional operating room attire (i.e., caps, masks, gloves and gowns). A positive static pressure is maintained between the enclosure and the outside. . This feature is important for preventing operative site contamination from areas outside the enclosure. Particularly together with means defining an air curtain at the opening, the aspect of excluding outside particles provides the ability to conduct aseptic surgical technique in remote areas such as battlefields and on the site of mass casualty events. Surgical necessities and conveniences are preferably included, for example temperature control apparatus for the filtered air and preferably for the base. Ports in at least one endwall allow access for moving a surgical subject into the enclosure and/or to seal over connection lines traversing the walls of the enclosure. A viewing apparatus in the form of a movably mounted microscope can be directed at the operating field as needed for performing microsurgical procedures and has a viewing port mounted on an extension to protrude from the enclosure through the openings provided for manual access.

SUMMARY OF THE INVENTION

It is an object of the invention to provide a mobile surgical theater providing highly particle-free air delivered in a substantially laminar flow pattern in a partial enclosure through which surgeons can access a surgical subject such that only the surgeons hands and forearms enter the enclosure.

It is also an object of the invention to facilitate surgery on a relatively small subject or area of a subject disposed within a partial enclosure having highly particle free air at a positive pressure differential relative to the air, whereby particles and other means of contamination are excluded from entering the enclosure.

It is a further object of the invention to facilitate veterinary surgery on laboratory animals by providing a convenient yet sterile area in which to conduct surgical procedures on the animals.

It is still another object to facilitate performance of surgical procedures on human patients (e.g., microsurgery, knee surgery, neurosurgery, ophthalmic surgery, vascular surgery, etc.) by providing a convenient yet sterile area in which to conduct the procedures, defined by a compact and mobile apparatus capable of transport to a location needed, via helicopter, ambulance, aircraft, ship, etc.

These and other objects are accomplished by conducting surgical procedures in a protected environment wherein a laminar flow of micro filtered air is passed from a top to a bottom of an enclosure with transparent panels defining a space for manual access of the surgeon's hands and arms. Air circulation is forced through a high performance HEPA filter between an inlet including the bottom of the enclosure and an outlet at the top, both including panels with an array of apertures for establishing laminar flow. A duct along an endwall of the enclosure carries filtered air to the top. A positive pressure differential is maintained between the inside of the surgical compartment and an outside. The enclosure rests on top of a mobile cabinet and has access ports for connection lines and also for bringing the surgical subject into the enclosure. For experimental animals, an access port for cage boxes can be provided. A microscope is movably mounted in the enclosure, with the object lenses disposed outside the enclosure on an extension which can extend through the access port.

BRIEF DESCRIPTION OF THE DRAWINGS

There are shown in the drawings the embodiments of the invention as presently preferred. It should be understood that the invention is not limited to the precise arrangements and instrumentalities depicted, which are exemplary. The invention is capable of additional embodiments within the scope of the appended claims. In the drawings:

DETAILED DESCRIPTION OF THE PREFERRED EMBODIMENTS

Figure 1:
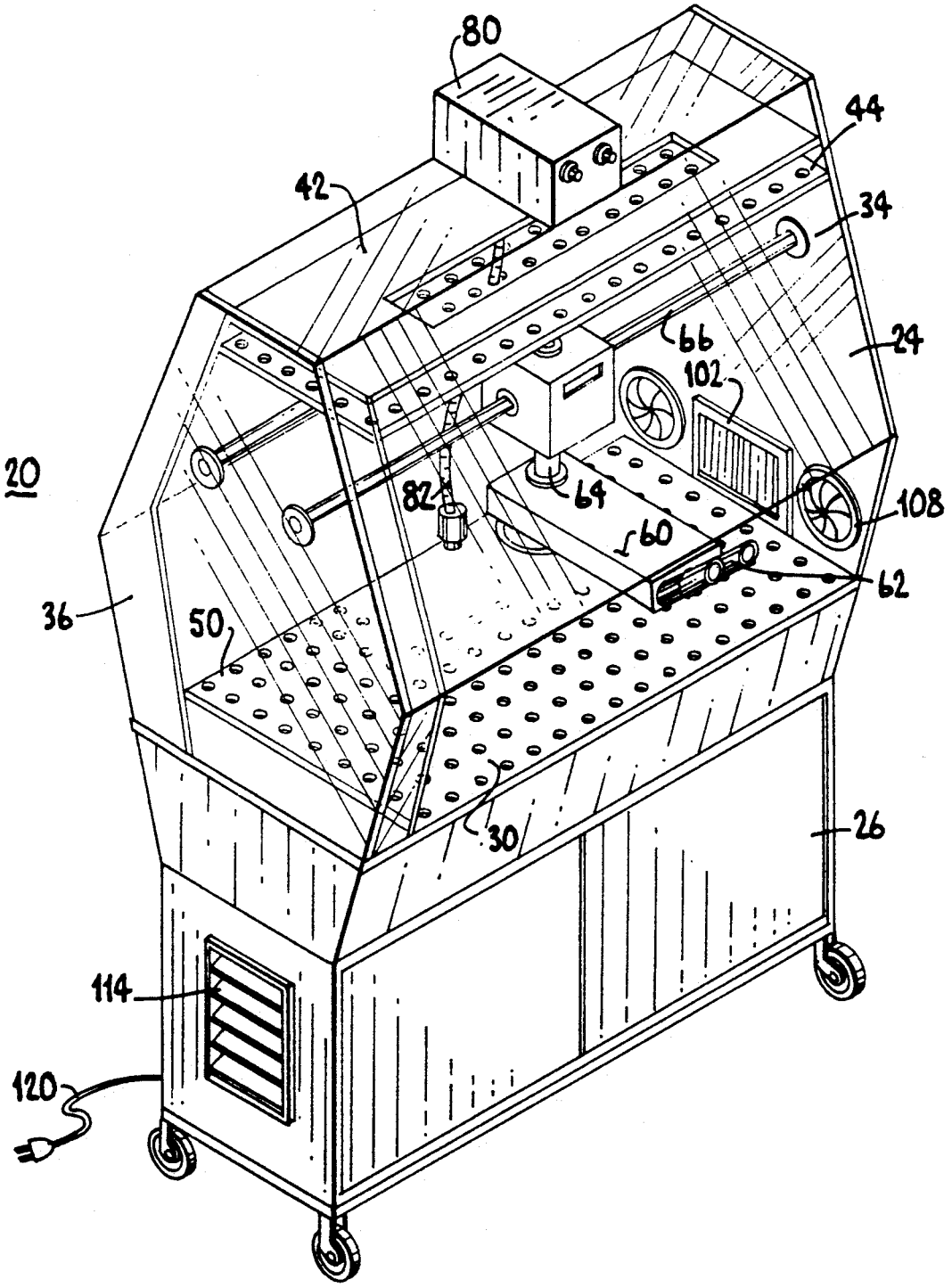
FIG. 1 is a perspective view of a mobile surgical compartment according to the invention.

As shown generally in FIG. 1, the mobile surgical compartment 20 of the invention includes a transparent upper enclosure 24 disposed on a cabinet 26. The enclosure 24 defines a protected air space over an operating field on the top panel 50 of the cabinet portion of the apparatus, enclosing the protected air space except for manual access openings 30, at the lower edges of inclined sidewalls 34 of enclosure 24. Manual access openings 30 are disposed immediately over the panel 50 that forms the operating field, such that the surgeon or the like can stand at the apparatus and manually perform procedures on a surgical subject in the apparatus through manual access openings 30, while viewing the subject through the inclined sidewalls 34 in the manner of a "salad bar". Corresponding inclined sidewalls 34 and manual access openings 30 are provided on both opposite sides of the apparatus, for use by two persons. If desired, a closure panel (not shown) can be provided on one or both sides in order to seal the protected space when one or both of the openings is not in use.

Figure 2:
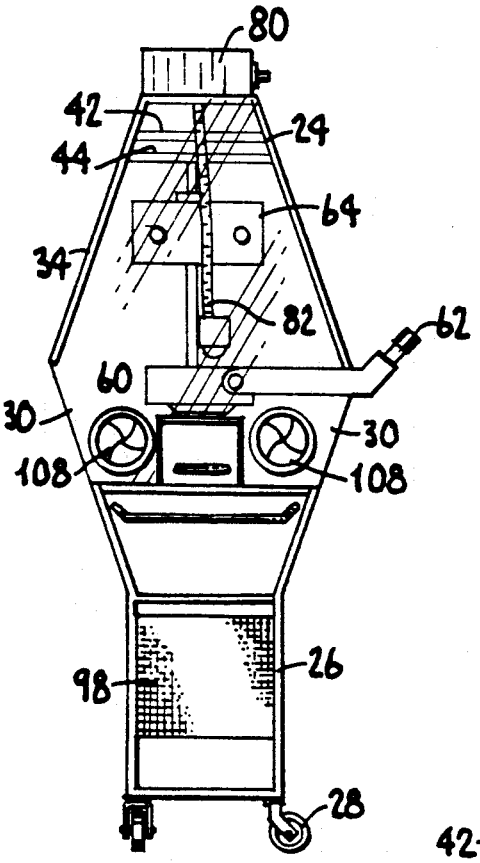
FIG. 2 is an elevation view thereof, from one end.
Figure 3:
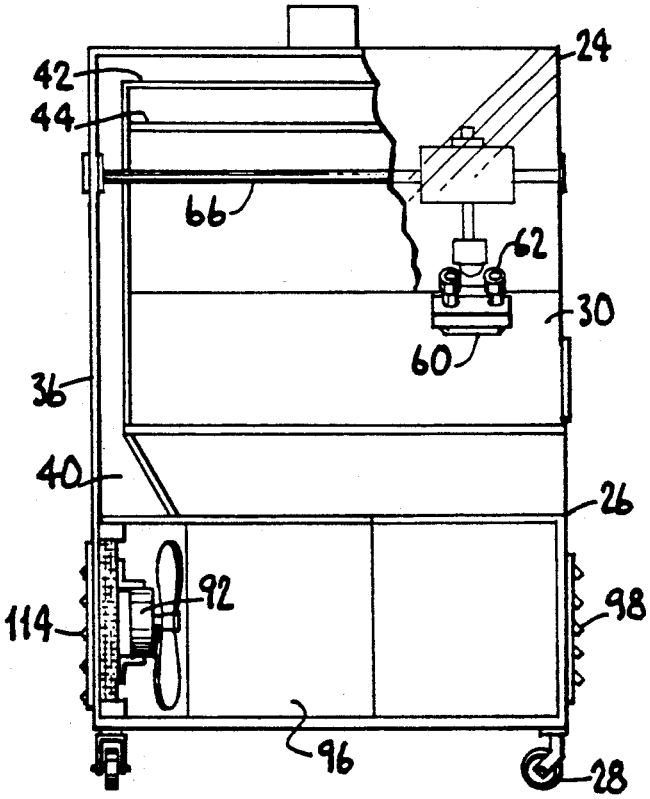
FIG. 3 is a cut away elevational view thereof.

Referring to FIGS. 1–3, a forced air filtering apparatus is arranged in the cabinet 26 of the apparatus and provides class 100 filtered air to the protected enclosure at a positive pressure relative to the room, thereby excluding airborne particles. The air is forced by a fan 92 through a HEPA filter block 96 disposed in the cabinet 26, and is led by a duct 40 along an endwall 36 to an upper part of the enclosure 24. A first panel 42 in the upper part of the enclosure has an elongated slot directing the filtered air downwardly into a plenum defined between the first panel 42 and a second panel 44, the latter having a plurality of openings distributed in an array across the length and width of the second panel 44. Air passes through the second panel 44 in a downward direction, providing a substantially laminar flow of air directed against the bottom panel 50. Bottom panel 50 also has a plurality of openings for passage of air. Air passing through the bottom panel is led by ducts 40 to the inlet to the fan/filter mechanism and is recirculated.

In an alternative embodiment, the slotted first panel 42 in the upper part of the enclosure may be eliminated. However, in order to maintain a constant flow of filtered air over the length of the compartment 20, the plurality of openings distributed in an array across the length and width of the second panel 44 must increase in size with distance from the duct 40 along the endwall. This maintains a constant flow of filtered air across the length of the compartment 20 where the use of consistently sized openings in the second panel 44 would result in a greater flow in the area of the panel closer to duct 40.

Additional air is inlet to the fan 92 and filter 96 from the room through one or more openings 98 in the cabinet 26, as additional air is needed to account for air passing outwardly through manual openings 30 into the room due to the positive pressure maintained in the enclosure 24.

In order to facilitate surgical operations, a magnifying viewer 60 is movably mounted inside the enclosure and portals 102, los are provided in an endwall of the enclosure, for passage of connection lines and/or for providing an opening through which the surgical subject (not shown) or an appendage of the surgical subject can be passed. A light source may be associated with the magnifying viewer, and preferably, a flexibly positionable fiber optic bundle 82 is provided to transmit light from a source 80 located outside of the enclosure to an area inside the enclosure selected by the operator (not shown).

The apparatus is useful for conducting surgical procedures, and provides a limited size area of highly particle free air that can be deployed wherever a surgical procedure is to by undertaken. The air circulation means includes a micro pore filter, specifically a HEPA filter 96 which produces class 100 air. As a result, the area inside the enclosure 24 is substantially more particle free than the typical hospital operating room. Positively charging the area inside the enclosure 24 assists in maintaining this class 100 air environment by keeping outside particles such as bacteria, smoke, dust, etc., from entering the enclosure. A fan 92 or similar means forces air through the filter 96. The air circulation means has at least-one inlet and at least one outlet. Preferably the at least one inlet includes an inlet from the enclosure, whereby the air passing from the enclosure can be recirculated. Additionally or alternatively, an inlet draws air from the room into the circulation system, to be filtered, and directed downwardly into the operating field area.

The enclosure 24 defining the surgical compartment has a top panel 44, a bottom panel 50, endwalls 36 and sidewalls 34, at least one of the sidewalls including a transparent panel for viewing an inside of the surgical compartment, the at least one of the sidewalls 34 terminating at a space from the bottom panel for manual access to the inside of the surgical compartment 24 through access openings 30. Duct means 40 couple the outlet of the air circulation means to the top of the surgical compartment 24, said top having a plurality of openings for directing filtered air from the air circulation means into the surgical compartment, the air circulation means and the duct means being operable to maintain a positive pressure differential between the inside of the surgical compartment and an outside.

The openings in the top panel 44 may be inclined toward the sidewalls, or varied in size, for establishing an air curtain along the sidewalls and for enabling a low turbulence central downward flow within a perimeter defined by the air curtain. The air curtain extends downwardly from the lower edge of the sidewalls. In a preferred embodiment, the enclosure widens in at least one direction proceeding downwardly from the top toward the access openings, as shown in FIG. 2. Too maintain a low turbulence flow in such a device it is appropriate to direct a larger volume flow of air along the sides than in the center of the enclosure. For these purposes the air flow can be adjusted by corresponding adjustment of the relative dimensions and orientation of the openings in top panel 44, i.e., the openings adjacent the sides being relatively larger and/or more outwardly inclined than those in the center of the top panel.

The top panel 44 and the bottom panel 50 of the surgical compartment each include an array of apertures leading to the duct means, whereby a laminar air flow is maintained in a vertical direction from the top panel 44 to the bottom panel 50. The sidewalls 34 of the surgical compartment include two opposite sidewalls terminating at a space from the bottom panel for manual access through openings 30, each of said opposite panels including a transparent panel for direct viewing of the inside of the surgical compartment 24, the duct means being defined in part by at least one endwall 36 having two panels spaced to define an air flow path from the outlet of the air circulation means to the top panel 44. The surgical compartment is defined by a plurality of transparent sidewalls and endwalls disposed on a cabinet including the air circulation means.

Figure 5:
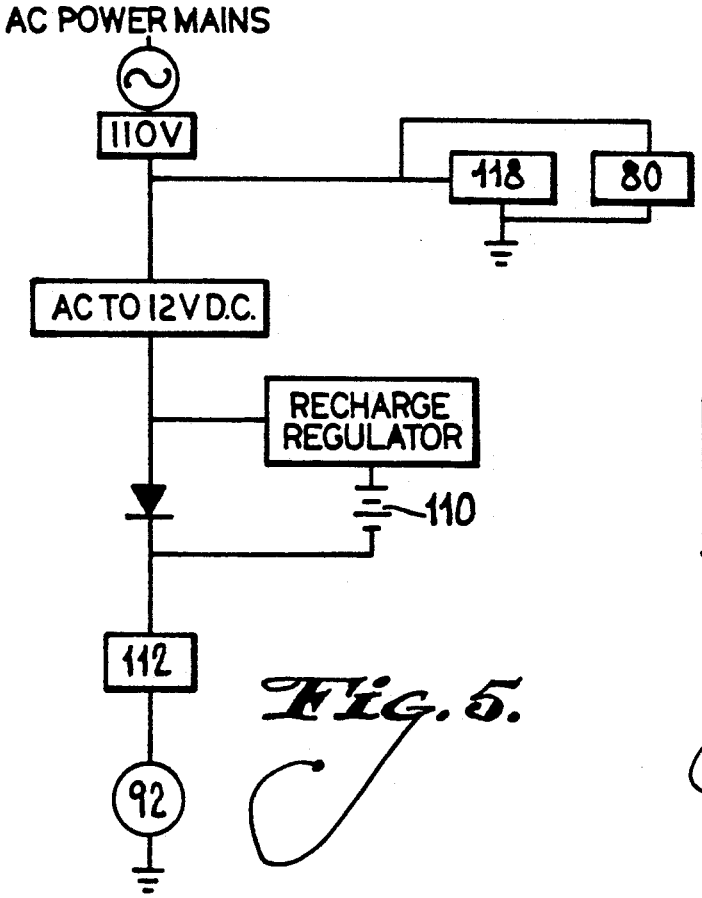
FIG. 5 is a schematic diagram showing the electrical components of the invention; and, FIG. 6 is a front elevation view of an adjustable power supply according to the invention, for use in association with a manometer, as shown.
Figure 6:
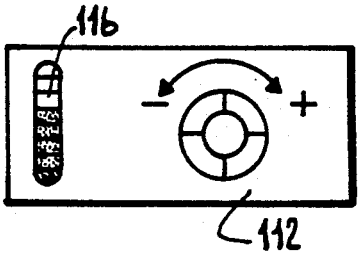

The cabinet is preferably made mobile. The cabinet is small enough to be carried and/or transported in a vehicle, and can be wheeled about by means of pivoting casters 28, enabling the apparatus to be moved to the site of the patient, if desired, or for permitting out of the way storage during periods of nonuse. Referring to FIGS. 1, 5 and 6, a standard electrical connection 120 for the air circulation system and illumination means is coupleable to the AC power mains.

At least one closable access port 102 in an endwall of the surgical compartment is dimensioned to pass at least one of a surgical subject, a container for a surgical subject and connection lines for at least one of electrical connections and flow connections. The surgical subject, container and connection lines are not shown in the drawings. It is also possible to provide connection means 118 within the cabinet, particularly for electrically powered apparatus such as heaters, electric arc or laser scalpels, cautery devices and the like. A portal 102 for access of the subject, as used for humans, can be dimensioned to accommodate an appendage of the subject such as an arm, leg, head, etc. However, the mobile operating compartment is especially useful for veterinary surgery involving laboratory animals such as mice, rats, rabbits and the like. The smaller sized animals can be brought to the surgery compartment 24 while housed protectively in a cage box (not shown) having sealed walls and an air permeable filter cover, and only removed from the cage box when disposed in the protected environment of the mobile compartment. For this purpose, a movable door panel can be slidable over an opening in the endwall of the upper enclosure, for opening and closing an access route whereby the cage box is moved into and out of the compartment. The cage box port 102 is fully closable. One or more additional ports 108 for connection lines preferably have a resilient membrane disposed across an opening or are provided with a flexible tube which closes resiliently via elastic, such that the connection line port is closable over any connection line traversing the connection line port. As a result, the internal volume of the surgical compartment 24 is sealed from the room, except at the openings 30, through which the surgeon's hands extend during the operation.

The surgeon's head, which is a source of pathogens due to respiration, falling hair and the like, remains outside of the surgical compartment, and the surgeon views the subject through the transparent sidewall. Preferably, the sidewall 34 is inclined, enabling the surgeon to lean slightly over the patient, and also preventing reflections of windows and the like from obscuring the view of the subject. The angle of inclination is preferably steeper than 45°, to likewise avoid reflections from overhead light sources such as ceiling lamps.

To assist in microsurgical procedures and also to avoid the need for the surgeon to come into closer proximity to the subject, a viewer 60 can be disposed at least partly within the surgical compartment, the viewer being movably mounted for vertical and horizontal displacement in the surgical compartment and including a view port 62 extending at least to said transparent panel in the sidewall. The viewer 60 can be a microscope on a carriage movably attached to the sidewalls along guide rails, the microscope having a displaced image presentation means at the view port 62, the view port extending beyond the transparent panel. The microscope is vertically movable on the carriage 64 and the carriage is horizontally movable on the guide rails 66. It is also possible to use other forms of enhanced viewing apparatus in the same manner. For example, a video monitor can be provided with optical means for capturing an image disposed inside compartment 24 and a display CRT disposed outside, in an area nearby the area of the sidewall through which the surgeon looks for viewing the subject directly. At least part of the viewing apparatus preferably is removable from the enclosure to reduce obstruction of vision when not needed.

The mobile surgical compartment 20 as disclosed comprises a wheeled cabinet 26, a filter 96 and electrically powered air circulation means 92, preferably mounted compactly within the cabinet. The air circulation means is operable to draw air from outside the cabinet and from a top panel 50 of the cabinet, said top panel 50 of the cabinet having a plurality of apertures in an array and defining a work surface on an upper surface thereof. The cabinet top panel 50 corresponds to a bottom panel of the partial enclosure. The partial enclosure is disposed on the cabinet, the partial enclosure having transparent panels on two opposite sidewalls terminating at a space above the bottom panel sufficient to allow access of a user's arms, the partial enclosure including an outlet duct means communicating with the air circulation means via duct means in the cabinet, and the outlet duct means leading to a plenum in a top of the partial enclosure having a plurality of apertures directed toward the apertures in the top panel of the cabinet. Means are provided for operating the air circulation means to maintain a positive pressure differential between an inside and an outside of the partial enclosure.

Figure 4:
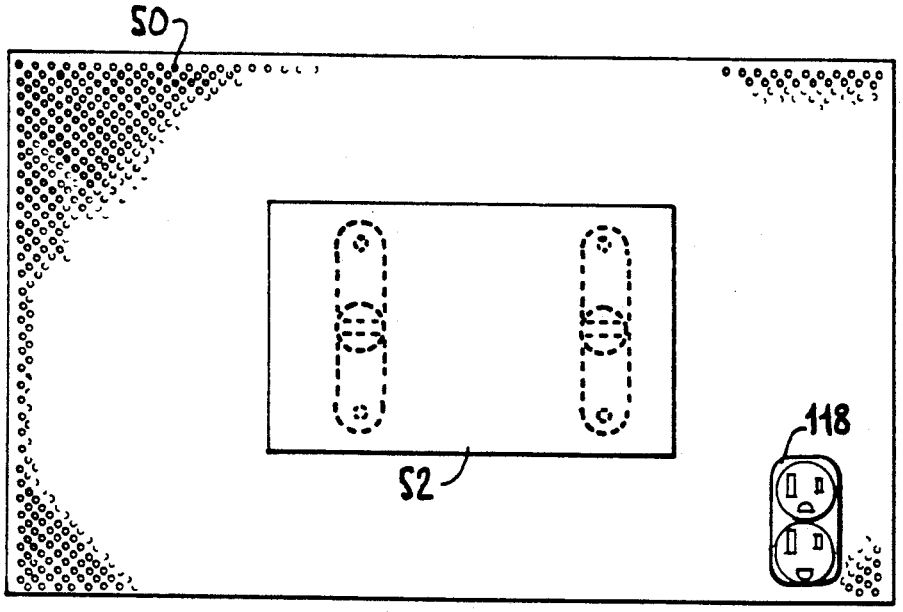
FIG. 4 is a top plan view of the enclosure bottom panel thereof showing a tiltable worktable and a surgical assistance apparatus.

Referring to FIG. 4, at least one surgical assistance apparatus 118 is disposed in the cabinet. The surgical assistance apparatus can be, for example, an air temperature control for the top panel of the cabinet, connections for a water blanket to heat or cool the subject or the base panel supporting the subject, a water supply and/or liquid drain means, and electrical connections 118 for power supply, cautery apparatus, signal lines for electronic monitors such as ECG equipment, and the like. The bottom panel can include an adjustably positionable table 52 for supporting the subject, which table can be vertically adjustable, tiltable, or otherwise adaptable to the subject or to the surgeon. The surgical assistance apparatus preferably includes a viewing apparatus 60, and illumination means 82. One or more surgical assistance apparatus can be disposed in the cabinet 26 rather than in the enclosure 24. For example, a temperature control for the top panel of the cabinet, liquid drain means and electrical power connections as well as signal lines or complete monitoring apparatus, can be mounted in the cabinet.

An access opening 108 in the partial enclosure is dimensioned to receive connection lines, the access opening including a closure for sealingly receiving connection lines traversing the access opening. Preferably, a subject access port 102 in the endwall is dimensioned to receive at least one of a surgical subject and a container for a surgical subject. A microscope 60 is movably disposed in the partial enclosure and having a viewing means 62 movable to a point outside the partial enclosure through said space above the bottom panel.

The invention also encompasses a method for conducting surgical procedures on a subject. The method comprises the steps of: providing an enclosure with a substantially laminar flow of micro filtered air passing vertically from a top of an enclosure to a bottom, the enclosure substantially enclosing a space and having openings below transparent panels on two opposite sides for manual access, moving the subject into the space, viewing the subject through the transparent panels and through a viewing apparatus having an object apparatus accessible from outside the space, and conducting the surgical procedure while the subject is disposed in the laminar flow.

According to a preferred embodiment the subject is a laboratory animal. Accordingly, moving the subject into the space can include moving a substantially isolated cage box into the enclosure and opening the cage box to remove the animal. The animal can be returned to the cage box at a conclusion of the surgical procedure, without ever having left the confines of a protected environment. According to another embodiment, the subject can be a larger animal or a human, and moving the subject into the space includes passing at least a portion of the subject through a portal in the partial enclosure and conducting the surgical procedure on said portion.

The enclosure is preferably movable such that the method can further comprise moving the enclosure into an area of the subject, and providing to the enclosure surgical utilities via connection lines sealably passed through a wall of the enclosure.

The invention having been disclosed, a number of variations will now become apparent to persons skilled in the art. Reference should be made to the appended claims rather than the foregoing specification in order to assess the scope of the invention in which exclusive rights are claimed.

We claim:

1. An apparatus for conducting surgical procedures, comprising:

an air circulation means including a micro pore filter and means for forcing air through the filter, the air circulation means having at least one inlet and at least one outlet;

a surgical compartment defined by a top panel, a bottom panel and sidewalls, at least one of the sidewalls including a transparent panel for viewing an inside of the surgical compartment, the at least one of the sidewalls terminating at a space from the bottom panel for manual access to the inside of the surgical compartment, at least one other of said sidewalls defining an endwall including an access port dimensioned for passage of an appendage of a surgical subject into the surgical compartment, such that the surgical procedures can be conducted on the appendage in a protected environment inside the surgical compartment, with the surgical subject otherwise located outside the surgical compartment;

duct means coupling the outlet of the air circulation means to a top of the surgical compartment, said top having a plurality of openings for directing filtered air from the air circulation means into the surgical compartment, the air circulation means and the duct means being operable to maintain a positive pressure differential between the inside of the surgical compartment and an outside, whereby ingress of particles into the surgical compartment is minimized.

2. The apparatus according to claim 1, wherein the top panel and the bottom panel of the surgical compartment each include an array of apertures leading to the duct means, whereby a laminate air flow is maintained in a vertical direction from the top panel to the bottom panel.

3. The apparatus according to claim 2, wherein the sidewalls of the surgical compartment include two opposite sidewalls terminating at a space from the bottom panel for manual access, each of said opposite panels including a transparent panel for viewing the inside of the surgical compartment, the duct means being defined in part by at least one end sidewall having two panels spaced to define an air flow path from the outlet of the air circulation means to the top panel.

4. The apparatus according to claim 3, wherein the surgical compartment is defined by a plurality of transparent sidewalls and endwalls disposed on a cabinet including the air circulation means.

5. The apparatus according to claim 4, further comprising ground engaging wheels disposed under the cabinet, whereby the cabinet is mobile.

6. The apparatus according to claim 7, further comprising a plurality of access ports in the endwall of the surgical compartment, the access ports including a cage box port dimensioned to receive an animal cage box, and a connection line port, the cage box port being fully closable and the connection line port being closable over a connection line traversing the connection line port.

7. An apparatus for conducting surgical procedures, comprising:

an air circulation means including a micro pore filter and means for forcing air through the filter, the air circulation means having at least one inlet and at least one outlet;

a surgical compartment defined by a top panel, a bottom panel and sidewalls, at least one of the sidewalls including a transparent panel for viewing an inside of the surgical compartment, the at least one of the sidewalls terminating at a space from the bottom panel for manual access to the inside of the surgical compartment;

duct means coupling the outlet of the air circulation means to a top of the surgical compartment, said top having a plurality of openings for directing filtered air from the air circulation means into the surgical compartment, the air circulation means and the duct means being operable to maintain a positive pressure differential between the inside of the surgical compartment and a outside; and, a viewer disposed at least partly within the surgical compartment, the viewer being movably mounted for vertical and horizontal displacement in the surgical compartment and including a view port extending at least to said transparent panel in the sidewall.

8. The apparatus according to claim 7, wherein the viewer comprises a microscope on a carriage movably attached to the sidewalls along guide rails, the microscope having a displaced image presentation means at the view port, the view port extending beyond the transparent panel.

9. The apparatus according to claim 8, further comprising means in the carriage operable for fixing a vertical displacement of the microscope, whereby the microscope is vertically movable on the carriage and the carriage is horizontally movable on the guide rails.

10. A mobile surgical compartment, comprising:

a wheeled cabinet having a top panel with an upper surface;

a filter and electrically powered air circulation means in the cabinet, the air circulation means being operable to draw air from outside the cabinet and from the top panel of the cabinet, said top panel of the cabinet having a plurality of apertures in an array and defining a work surface on the upper surface of the top panel of the cabinet, and duct means in the cabinet coupling the air circulation means to said apertures;

a partial enclosure disposed on the upper surface of the op panel of the cabinet, the partial enclosure having transparent panels on two opposite sidewalls terminating at a space above the top panel of the cabinet sufficient to allow access of arms of an attendant located outside of the partial enclosure, the partial enclosure including an outlet duct means communicating with the air circulation means via the duct means in the cabinet, and the outlet duct means leading to a plenum in a top of the partial enclosure having a plurality of apertures directed toward the apertures in the top panel of the cabinet, the sidewalls including at least one endwall including an access port dimensioned for passage of an appendage of a surgical subject into the surgical compartment, such that surgical procedures can be conducted on the appendage in a protected environment inside the partial enclosure, with the surgical subject otherwise located outside the surgical compartment; and, means for operating the air circulation means to maintain a positive pressure differential between an inside and an outside of the partial enclosure, whereby ingress of particles into the partial enclosure is minimized.

11. The apparatus according to claim 10, wherein the apparatus is adapted for external connection via connection lines, and further comprising an access opening in the partial enclosure dimensioned to receive the connection lines, the access opening including a closure for sealingly receiving the connection lines traversing the access opening.

12. A mobile surgical compartment, comprising:

a wheeled cabinet having a top panel with an upper surface;

a filter and electrically powered air circulation means in the cabinet, the air circulation means being operable to draw air from outside the cabinet and from the top panel of the cabinet, said top panel of the cabinet having a plurality of apertures in an array and defining a work surface on the upper surface of the top panel of the cabinet, and duct means in the cabinet coupling in the air circulation means to said apertures;

a partial enclosure disposed on the upper surface of the top panel of the cabinet, the partial enclosure having transparent panels on two opposite sidewalls terminating at a space above the top panel of the cabinet sufficient to allow access of arms of an attendant located outside of the partial enclosure, the partial enclosure including an outlet duct means communicating with the air circulation means via the duct means in the cabinet, and the outlet duct means leading to a plenum in a top of the partial enclosure having a plurality of apertures directed toward the apertures in the top panel of the cabinet;

means for operating the air circulation means to maintain a positive pressure differential between an inside and an outside of the partial enclosure; and a microscope movably disposed in the partial enclosure and having a viewing means movable to a point outside the partial enclosure through said space above the top panel of the cabinet.

13. The apparatus according to claim 12, further comprising a subject access port dimensioned to receive at least one of a surgical subject and a container for a surgical subject.

14. A method for conducting surgical procedures on a subject, comprising the steps of:

providing an enclosure with a substantially laminar flow of micro filtered air passing vertically from a top of an enclosure to a bottom, the enclosure substantially enclosing a space and having openings below transparent panels on two opposite sides for manual access;

moving the subject into the space;

viewing the subject through the transparent panels and through a viewing apparatus having a view port accessible from outside the space;

conducting the surgical procedure while the subject is disposed in the laminar flow.

15. The method of claim 14, wherein the subject is a laboratory animal and wherein moving the subject into the space includes moving a substantially isolated cage box into the enclosure and opening the cage box to remove the animal, and further comprising returning the animal to the cage box at a conclusion of the surgical procedure.

16. The method of claim 14, wherein moving the subject into the space includes passing at least a portion of the subject through a portal in the partial enclosure and conducting the surgical procedure on said portion.

17. The method of claim 14, wherein the subject is a human and wherein moving the subject into the space includes moving an appendage of the human into the enclosure.

18. The method of claim 14, wherein the enclosure is movable and further comprising moving the enclosure into an area of the subject, and providing to the enclosure surgical utilities via connection lines sealably passed through a wall of the enclosure.

* * * * *